US007926317B2

(12) United States Patent
Soga et al.

(10) Patent No.: US 7,926,317 B2
(45) Date of Patent: Apr. 19, 2011

(54) PRESSING MACHINE, CRANK PRESSING MACHINE, AND VIBRATION PROCESSING METHOD IN THESE MACHINES

(75) Inventors: Mitsumasa Soga, Isehara (JP); Hideo Itakura, Isehara (JP)

(73) Assignees: Amada Press Technology Co., Ltd., Kanagawa (JP); Amada Company, Limited, Kanagawa (JP)

( * ) Notice: Subject to any disclaimer, the term of this patent is extended or adjusted under 35 U.S.C. 154(b) by 539 days.

(21) Appl. No.: 11/994,009

(22) PCT Filed: Jun. 27, 2006

(86) PCT No.: PCT/JP2006/312824

§ 371 (c)(1),
(2), (4) Date: Mar. 5, 2008

(87) PCT Pub. No.: WO2007/001005

PCT Pub. Date: Jan. 4, 2007

(65) Prior Publication Data

US 2008/0216675 A1 Sep. 11, 2008

(30) Foreign Application Priority Data

Jun. 28, 2005 (JP) ..... 2005-188825
Jun. 21, 2006 (JP) ..... 2006-171463

(51) Int. Cl.
*B21D 9/08* (2006.01)
*B21J 9/18* (2006.01)

(52) U.S. Cl. ..... 72/20.1; 72/443; 72/450; 100/49; 100/282

(58) Field of Classification Search ..... 72/20.1, 72/417, 420, 443, 450, 454; 100/49, 420, 100/282

See application file for complete search history.

(56) References Cited

U.S. PATENT DOCUMENTS

| | | | | |
|---|---|---|---|---|
| 3,052,200 | A * | 9/1962 | Dehn et al. | 72/417 |
| 4,107,973 | A * | 8/1978 | Smejkal et al. | 72/450 |
| 5,069,060 | A * | 12/1991 | Ishii | 72/443 |
| 5,231,860 | A * | 8/1993 | Tsuruta et al. | 72/20.1 |
| 5,669,257 | A * | 9/1997 | Inoue et al. | 72/20.1 |
| 6,520,077 | B1 * | 2/2003 | Minagawa et al. | 100/289 |
| 6,823,708 | B1 * | 11/2004 | Okubo | 72/420 |
| 6,871,586 | B2 * | 3/2005 | Teraoka | 100/49 |
| 7,284,407 | B2 * | 10/2007 | Imaeda | 72/443 |
| 7,574,891 | B2 * | 8/2009 | Futamura et al. | 72/454 |

(Continued)

FOREIGN PATENT DOCUMENTS

JP 11-226798 8/1999

(Continued)

OTHER PUBLICATIONS

English language Abstract of JP 2006-082102.

(Continued)

*Primary Examiner* — David B Jones
(74) *Attorney, Agent, or Firm* — Greenblum & Bernstein, P.L.C.

(57) ABSTRACT

A press machine includes: an electric motor for raising and lowering a slide by rotating a crank shaft; a motion datum receiving module through which, by an input operation, an operator inputs a motion datum including, as input items, height positions at which the slide starts and ends an oscillation process, a speed at which the slide carries out the oscillation process, an angle at which the crank shaft is rotated in a direction during a drive-in operation, and an angle at which the crank shaft is rotated in the other direction during a return operation; a motion pattern generator for generating a motion pattern of the slide on the basis of the motion datum inputted through the motion datum receiving module; and a motor controlling module for controlling the electric motor on the basis of the motion pattern generated by the generator.

8 Claims, 6 Drawing Sheets

U.S. PATENT DOCUMENTS

2005/0250966 A1 11/2005 Funakoshi et al.

FOREIGN PATENT DOCUMENTS

| | | |
|---|---|---|
| JP | 2004-001016 | 1/2004 |
| JP | 2004-017098 | 1/2004 |
| JP | 2006-082102 | 3/2006 |

OTHER PUBLICATIONS

English language Abstract of JP 2004-017098.
English language Abstract of JP 2004-001016.
English language Abstract of JP 11-226798.

* cited by examiner

PRESSING MACHINE, CRANK PRESSING MACHINE, AND VIBRATION PROCESSING METHOD IN THESE MACHINES

TECHNICAL FIELD

The present invention relates to a press machine for, and a crank press machine for, applying an oscillation process to a workpiece using cooperation between a punching mold and a die mold while oscillating a slide, as well as to an oscillation processing method adopted for the machines.

BACKGROUND ART

Various processing methods are adopted for press machines. One of the processing methods is an oscillation processing method of molding a workpiece by applying a pressing load smaller than a regular pressing load to the workpiece while oscillating a slide. This oscillation process is carried out, for example, by alternately repeating what is termed as a drive-in operation and what is termed as a return operation. The drive-in operation is that in which a rotation of a crank shaft in a direction lowers a slide, and thereby a punching mold drives a workpiece into a die mold. The return operation is that in which a rotation of the crank shaft in the other direction raises the slide, and thereby the punching mold is returned upward.

A press machine of carrying out the oscillation process includes: a servo motor for raising and lowering the slide by rotating the crank shaft; and a controller for doing things such as controlling this servo motor. A CRT touch panel display is connected to the controller. Through this CRT touch panel display, motion data are inputted by the operator's input operation. A motion datum includes, as input items, a height position and speed at which the slide starts an oscillation process, a height position and speed at which the slide carries out the first drive-in operation, a height position and speed at which the slide carries out the first return operation, a height position and speed at which the slide carries out the second drive-in operation, a height position and speed at which the slide carries out the second return operation, . . . , a height position and speed at which the slide carries out the (N−1)th drive-in operation, a height position and speed at which the slide carries out the (N−1)th return operation, a height position and speed at which the slide carries out the Nth drive-in operation, a height position and speed at which the slide carries out the Nth return operation.

The controller includes a CPU, a ROM, a RAM and the like. The CPU includes: a function as a motion pattern generator for generating a motion pattern of the slide on the basis of a motion datum inputted through the CRT touch panel display; and a function as a motor controller for controlling the servo motor on the basis of the motion pattern generated by the motion pattern generator.

Once the motion datum is inputted through the CRT touch panel display by the operator's input operation, the motion pattern generator generates the motion pattern of the slide on the basis of the motion datum inputted through the CRT touch panel display. Thus, the motor controller controls the servo motor on the basis of the motion pattern generated by the motion pattern generator. This makes it possible for the press machine to alternately repeat the drive-in operation and the return operation, and to thereby apply the oscillation process to the workpiece using cooperation between the punching mold and the die mold while oscillating the slide.

It should be noted that a prior art concerning the present invention is disclosed by Japanese Patent Application Laid-open Publication No. Hei. 11-226798 (Patent Document 1).

The press machine for carrying out the oscillation process generates the motion pattern on the basis of the motion datum including, as input items, the height position and speed at which the slide carries out each drive-in operation as well as the height position and speed at which the slide carries out each return operation, in addition to the height position and speed at which the slide starts the oscillation process as well as the height position and speed at which the slide ends the oscillation process. For this reason, as the drive-in operations and the return operations are increased in number, or as the number of times the slide is oscillated is increased, the number of input items included in the motion datum is increased. As a result, it takes a longer time for the operator to input the datum, and this makes the operator's work complicated. Particularly in a case where, as an input item included in the motion datum, the height position at which the slide starts the oscillation process needs to be changed, the motion datum has to be modified to a large extent. This makes the operator's work more complicated.

It should be noted that, because the press machine applies the oscillation process to the workpiece by alternately repeating the drive-in operation linked with the slide's descent and the return operation linked with the slide's ascent, it takes long for the press machine to carry out the oscillation process.

The present invention has been made for the purpose of solving the foregoing problems. A first object of the present invention is to provide a press machine, a crank press machine and an oscillation processing method adopted for the machines, which make it possible to check the increase in the number of input items included in a motion datum, and thus to check the increase in time needed for an operator to input the datum, as well as to accordingly enhance the operator's work efficiency.

A second object of the present invention is to provide a press machine, a crank press machine and an oscillation processing method adopted for the machines, which are capable of holding a slide's oscillation frequency virtually constant during an oscillation process, and thereby holding a pressing load virtually even, as well as of improving the precision with which a workpiece is molded.

A third object of the present invention is to provide a press machine, a crank press machine and an oscillation processing method adopted for the machines, which are capable of carrying out an oscillation process while oscillating the slide without the return operation linked with the slide's ascent. Thus, time needed for the oscillation process is reduced, accordingly enhancing the productivity.

A fourth object of the present invention is to provide a press machine, a crank press machine and an oscillation processing method adopted for the machines, which are capable of eliminating the abrasion between the punch mold and the workpiece, of checking the wear of the mold, and thereby extending the life of the mold. The provided press machine, the crank press machine and the oscillation processing method adopted for the machines, are also capable of checking the workpiece from being damaged, and thereby of improving the processing quality.

DISCLOSURE OF THE INVENTION

For the purpose of achieving the foregoing objects, a first aspect of the present invention is a press machine for applying an oscillation process to a workpiece using cooperation between a punching mold and a die mold while oscillating a slide by alternately repeating a drive-in operation for causing the punching mold to drive the workpiece into the die mold through lowering the slide and a return operation for returning the punching mold upward through raising the slide. The press machine includes: an actuator for raising and lowering the slide; motion datum receiving means through which, by an input operation, an operator inputs a motion datum including, as input items, a height position at which the slide starts the oscillation process, a height position at which the slide ends the oscillation process, a speed at which the slide carries out the oscillation process, a lowered amount of the slide during the drive-in operation, and a raised amount of the slide during the return operation; motion pattern generating means for generating a motion pattern of the slide on the basis of the motion datum inputted through the motion datum receiving means; and actuator controlling means for controlling the actuator on the basis of the motion pattern generated by the motion pattern generating means.

In the case of the first aspect of the present invention, once the motion datum is inputted through the motion datum receiving means by the operator's input operation, the motion pattern generating means generates a motion pattern of the slide on the basis of the motion datum inputted through the motion datum receiving means. Subsequently, the actuator controlling means controls the actuator on the basis of the motion pattern generated by the motion pattern generating means. This makes the press machine capable of applying the oscillation process to the workpiece using the cooperation between the punching mold and the die mold while oscillating the slide by alternately repeating the drive-in operation and the return operation.

In addition, even when the drive-in operation and return operation are increased in number, or even when the number of times the slide is oscillated is increased, the press machine is capable of checking the increase in the number of input items included in the motion datum. This is because the motion pattern is generated on the basis of the motion datum including, as input items, the height position at which the slide starts the oscillation process, the height position at which the slide ends the oscillation process, the speed at which the slide carries out the oscillation process, a lowered amount of the slide during the drive-in operation, and a raised amount of the slide is raised during the return operation. For the same reason, a slight modification in the motion datum is sufficient for the press machine to cope particularly with a case where, as one of the input items included in the motion datum, the height position at which the slide starts the oscillation process needs to be changed.

A second aspect of the present invention is a crank press machine for applying an oscillation process to a workpiece using cooperation between a punching mold and a die mold while oscillating a slide by alternately repeating a drive-in operation for causing the punching mold to drive the workpiece into the die mold through lowering the slide by rotating a crank shaft in a first direction and a return operation for returning the punching mold upward through raising the slide by rotating the crank shaft in a second direction. The crank press machine includes: an electric motor for raising and lowering the slide by rotating the crank shaft; motion datum receiving means through which, by an input operation, an operator inputs a motion datum including, as input items, a height position at which the slide starts the oscillation process, a height position at which the slide ends the oscillation process, a speed at which the slide carries out the oscillation process, an angle at which the crank shaft is rotated in the first direction during the drive-in operation, and an angle at which the crank shaft is rotated in the second direction during the return operation; motion pattern generating means for generating a motion pattern of the slide on the basis of the motion datum inputted through the motion datum receiving means; and motor controlling means for controlling the electric motor on the basis of the motion pattern generated by the motion pattern generating means.

In the case of the second aspect of the present invention, once the motion datum is inputted through the motion datum receiving means by the operator's input operation, the motion pattern generating means generates a motion pattern of the slide on the basis of the motion datum inputted through the motion datum receiving means. Subsequently, the motor controlling means controls the electric motor on the basis of the motion pattern generated by the motion pattern generating means. This makes the press machine capable of applying the oscillation process to the workpiece using the cooperation between the punching mold and the die mold while oscillating the slide by alternately repeating the drive-in operation and the return operation.

In addition, even when the drive-in operation and return operation are increased in number, or even when the number of times the slide is oscillated is increased, the press machine is capable of checking the increase in the number of input items included in the motion datum. This is because the motion pattern is generated on the basis of the motion datum including, as input items, the height position at which the slide starts the oscillation process, the height position at which the slide ends the oscillation process, the speed at which the slide carries out the oscillation process, an angle at which the crank shaft is rotated in a first direction during the drive-in operation, and an angle at which the crank shaft is rotated in a second direction during the return operation. For the same reason, a slight modification in the motion datum is sufficient for the press machine to cope particularly with a case where, as one of the input items included in the motion datum, the height position at which the slide starts the oscillation process needs to be changed.

In addition, even the crank press machine which raises and lowers the slide by rotating the crank shaft is capable of holding the slide's oscillation frequency virtually constant during the oscillation process, because the motion pattern is generated on the basis of the motion datum including, as input items, a speed at which the slide carries out the oscillation process, an angle at which the slide is rotated in the first direction during the drive-in operation, an angle at which the slide is rotated in the second direction during the return operation, and the electric motor is controlled on the basis of the motion pattern.

A third aspect of the present invention is a crank press machine for applying an oscillation process to a workpiece using cooperation between a punching mold and a die mold while oscillating a slide by alternately repeating a drive-in operation for causing the punching mold to drive the workpiece into the die mold through lowering the slide by rotating a crank shaft in a first direction and a return operation for returning the punching mold upward through raising the slide by rotating the crank shaft in a second direction. The crank press machine includes: an electric motor for raising and lowering the slide by rotating the crank shaft; motion datum receiving means to which, through an input operation, an operator inputs any one of a first motion datum and a second motion datum by selection. The first motion datum includes, as input items, a height position at which the slide starts the oscillation process, a height position at which the slide ends the oscillation process, a speed at which the slide carries out the oscillation process, an angle at which the crank shaft is rotated in the first direction during the drive-in operation, and an angle at which the crank shaft is rotated in the second direction during the return operation. The second motion datum includes, as input items, a height position at which the slide starts the oscillation process, a height position at which the slide ends the oscillation process, a speed at which the slide carries out the oscillation process, a lowered amount of the slide during the drive-in operation, and a raised amount of the slide during the return operation; motion pattern generating means for generating a motion pattern of the slide on the basis of the motion datum inputted through the motion datum receiving means; and motor controlling means for controlling the electric motor on the basis of the motion pattern generated by the motion pattern generating means.

In the case of the third aspect of the present invention, once any one of the first motion datum and the second motion datum is inputted through the motion datum receiving means by the operator's input operation, the motion pattern generating means generates a motion pattern of the slide on the basis of the motion datum inputted through the motion datum receiving means. Subsequently, the motor controlling means controls the electric motor on the basis of the motion pattern generated by the motion pattern generating means. This makes the press machine capable of applying the oscillation process to the workpiece using the cooperation between the punching mold and the die mold while oscillating the slide by alternately repeating the drive-in operation and the return operation.

In addition, even when the drive-in operation and return operation are increased in number, or even when the number of times the slide is oscillated is increased, the press machine is capable of checking the increase in the number of input items included in any one of the motion data. This is because the motion pattern is generated on the basis of the first motion datum or the second motion datum. The first motion datum includes, as the input items, the height position at which the slide starts the oscillation process, the height position at which the slide ends the oscillation process, the speed at which the slide carries out the oscillation process, an angle at which the crank shaft is rotated in a first direction during the drive-in operation, and an angle at which the crank shaft is rotated in a second direction during the return operation. The second motion datum includes, as input items, a height position at which the slide starts the oscillation process, a height position at which the slide ends the oscillation process, a speed at which the slide carries out the oscillation process, a lowered amount of the slide during the drive-in operation, and a raised amount of the slide during the return operation. For the same reason, a slight modification in the motion datum is sufficient for the press machine to cope particularly with a case where, as one of the input items included in the motion datum, the height position at which the slide starts the oscillation process needs to be changed.

In addition, even the crank press machine which raises and lowers the slide by rotating the crank shaft is capable of holding the slide's oscillation frequency virtually constant during the oscillation process, in a case where the motion pattern is generated on the basis of the first motion datum including, as input items, a speed at which the slide carries out the oscillation process, an angle at which the slide is rotated in the first direction during the drive-in operation, an angle at which the slide is rotated in the second direction during the return operation, and the electric motor is controlled on the basis of the motion pattern.

A fourth aspect of the present invention which is dependent on the third aspect is the crank press machine which includes the configuration according to the third aspect further including motion-datum-receiving-screen displaying means for displaying any one of a first motion datum receiving screen and a second motion datum receiving screen in accordance with the operator's selection. The first motion datum receiving screen is that with which the operator carries out an operation for inputting the first motion datum. The second motion datum receiving screen is that with which the operator carries out an operation for inputting the second motion datum.

In the case of the fourth aspect of the present invention, the motion-datum-receiving-screen displaying means displays any one of the first motion datum receiving screen and the second motion datum receiving screen in accordance with the operator's selection.

A fifth aspect of the present invention is a press machine for applying an oscillation process to a workpiece using cooperation between a punching mold and a die mold while oscillating a slide by alternately repeating a low-speed rotational operation for lowering the slide by rotating a crank shaft in a direction at a low speed and a high-speed rotational operation for lowering the slide by rotating the crank shaft in the same direction at a high speed. The press machine includes: an electric motor for raising and lowering the slide by rotating the crank shaft; motion datum receiving means to which, through an input operation, an operator inputs a motion datum including, as input items, a height position at which the slide starts the oscillation process, a height position at which the slide ends the oscillation process, a speed at which the crank shaft is rotated during the low-speed rotational operation, and a speed at which the crank shaft is rotated during the high-speed rotational operation; motion pattern generating means for generating a motion pattern of the slide on the basis of the motion datum inputted through the motion datum receiving means; and actuator controlling means for controlling the actuator on the basis of the motion pattern generated by the motion pattern generating means.

In the case of the fifth aspect of the present invention, once the motion datum is inputted through the motion datum receiving means by the operator's input operation, the motion pattern generating means generates a motion pattern of the slide on the basis of the motion datum inputted through the motion datum receiving means. Subsequently, the motor controlling means controls the electric motor on the basis of the motion pattern generated by the motion pattern generating means. This makes the press machine capable of applying the oscillation process to the workpiece using the cooperation between the punching mold and the die mold while oscillating the slide by alternately repeating the low-speed rotational operation and the high-speed rotational operation without carrying out any return operation by raising the slide.

In addition, even when the low-speed rotational operation and high-speed rotational operations are increased in number, or even when the number of times the slide is oscillated is increased, the press machine is capable of checking the increase in the number of input items included in the motion datum. This is because the motion pattern is generated on the basis of the motion datum including, as input items, the height position at which the slide starts the oscillation process, the height position at which the slide ends the oscillation process, the speed at which the crank shaft is rotated during the low-speed rotational operation, and the speed at which the crank shaft is rotated during the high-speed rotational operation. For the same reason, a slight modification in the motion datum is sufficient for the press machine to cope particularly with a case where, as one of the input items included in the motion datum, the height position at which the slide starts the oscillation process needs to be changed.

A sixth aspect of the present invention is a crank press machine for applying an oscillation process to a workpiece using cooperation between a punching mold and a die mold while oscillating a slide by alternately repeating a drive-in operation for causing the punching mold to drive the workpiece into the die mold through lowering the slide by rotating a crank shaft in a first direction and a return operation for returning the punching mold upward through raising the slide by rotating the crank shaft in a second direction, or by alternately repeating a low-speed rotational operation for lowering the slide by rotating a crank shaft in a direction at a low speed and a high-speed rotational operation for lowering the slide by rotating the crank shaft in the same direction at a high speed. The crank press machine includes: an electric motor for raising and lowering the slide by rotating the crank shaft; motion datum receiving means through which, by an input operation, an operator inputs any one of a first motion datum, a second motion datum and a third motion datum by selection, the first motion datum including, as input items, a height position at which the slide starts the oscillation process, a height position at which the slide ends the oscillation process, a speed at which the slide carries out the oscillation process, an angle at which the crank shaft is rotated in the first direction during the drive-in operation, and an angle at which the crank shaft is rotated in the second direction during the return operation, the second motion datum including, as input items, a height position at which the slide starts the oscillation process, a height position at which the slide ends the oscillation process, a speed at which the slide carries out the oscillation process, a lowered amount of the slide during the drive-in operation, and a raised amount of the slide during the return operation, as well as the third motion datum including, as input items, a height position at which the slide starts the oscillation process, a height position at which the slide ends the oscillation process, a speed at which the crank is rotated during the low-speed rotational operation, and a speed at which the crank shaft is rotated during the high-speed rotational operation; motion pattern generating means for generating a motion pattern of the slide on the basis of the motion datum inputted through the motion datum receiving means; and motor controlling means for controlling the electric motor on the basis of the motion pattern generated by the motion pattern generating means.

In the case of the third aspect of the present invention, once any one of the first motion datum, the second motion datum and the third motion datum is inputted through the motion datum receiving means by the operator's input operation, the motion pattern generating means generates a motion pattern of the slide on the basis of the motion datum inputted through the motion datum receiving means. Subsequently, the motor controlling means controls the electric motor on the basis of the motion pattern generated by the motion pattern generating means. This makes the press machine capable of applying the oscillation process to the workpiece using the cooperation between the punching mold and the die mold while oscillating the slide by alternately repeating the drive-in operation and the return operation. In this respect, the crank press machine is capable of applying the oscillation process to the workpiece using cooperation between the punching mold and the die mold while oscillating the slide by alternately repeating the low-speed rotational operation and the high-speed rotational operation without carrying out any return operation by raising the slide, in a case where the motion pattern is generated on the basis of the third motion datum, and the electric motor is controlled on the basis of the motion pattern.

In addition, even when the drive-in operation and return operation are increased in number (otherwise, the low-speed rotational operation and the high-speed rotational operation are increased in number), or even when the number of times the slide is oscillated is increased, the crank press machine is capable of checking the increase in the number of input items included in any one of the motion data. This is because the motion pattern is generated on the basis of the first motion datum, the second motion datum or the third motion datum. The first motion datum includes, as the input items, the height position at which the slide starts the oscillation process, the height position at which the slide ends the oscillation process, the speed at which the slide carries out the oscillation process, an angle at which the crank shaft is rotated in a first direction during the drive-in operation, and an angle at which the crank shaft is rotated in a second direction during the return operation. The second motion datum includes, as input items, a height position at which the slide starts the oscillation process, a height position at which the slide ends the oscillation process, a speed at which the slide carries out the oscillation process, a lowered amount of the slide during the drive-in operation, and a raised amount of the slide during the return operation. The third motion datum includes, as input items, a height position at which the slide starts the oscillation process, a height position at which the slide ends the oscillation process, a speed at which the crank shaft is rotated during the low-speed rotational operation, and a speed at which the crank shaft is rotated during the high-speed rotational operation. For the same reason, a slight modification in the motion datum is sufficient for the press machine to cope particularly with a case where, as one of the input items included in the motion datum, the height position at which the slide starts the oscillation process needs to be changed.

In addition, even the crank press machine which raises and lowers the slide by rotating the crank shaft is capable of holding the slide's oscillation frequency virtually constant during the oscillation process, in a case where the motion pattern is generated on the basis of the first motion datum including, as input items, a speed at which the slide carries out the oscillation process, an angle at which the crank shaft is rotated in the first direction during the drive-in operation, an angle at which the crank shaft is rotated in the second direction during the return operation, and the electric motor is controlled on the basis of the motion pattern.

A seventh aspect of the present invention which is dependent on the 6th aspect is the crank press machine which includes the configuration according to the 6th aspect further including motion-datum-receiving-screen displaying means for displaying any one of a first motion datum receiving screen, a second motion datum receiving screen and a third motion datum receiving screen in accordance with the operator's selection, the first motion datum receiving screen being that with which the operator carries out an operation for inputting the first motion datum, the second motion datum receiving screen being that with which the operator carries out an operation for inputting the second motion datum, and the third motion datum receiving screen being that with which the operator carries out an operation for inputting the third motion datum.

The seventh aspect of the present invention causes the motion-datum-receiving-screen displaying means to display any one of the first motion datum receiving screen, the second motion datum receiving screen and the third motion datum receiving screen in accordance with the operator's selection.

An eighth aspect of the present invention is an oscillation processing method for a press machine applying an oscillation process to a workpiece using cooperation between a punching mold and a die mold while oscillating a slide by lowering the slide by rotating a crank shaft in a direction. The method includes the step of alternately repeating a low-speed rotational operation for lowering the slide by rotating the crank shaft in the direction at a low speed and a high-speed rotational operation for lowering the slide by rotating the crank shaft in the direction at a high speed.

In the case of the eighth aspect of the present invention, the oscillation process is capable of being applied to the workpiece using the cooperation between the punching mold and the die mold while oscillating the slide without carrying out any return operation by raising the slide, because the slow-speed rotational operation and the high-speed rotational operation are alternately repeated.

In sum, even when the number of times the slide is oscillated is increased, the press machine as any one of the first to seventh aspects of the present invention is capable of checking the increase in the number of input items included in a corresponding motion datum, and thus of checking the increase in time needed for the operator to input the datum, accordingly enhancing the operator's work efficiency. In particular, a slight modification in the motion datum is sufficient for the press machine to cope with a case where, as one of the input items included in the motion datum, the height position at which the slide starts the oscillation process needs to be changed.

In addition, as the second aspect of the present invention, even the crank press machine which raises and lowers the slide by rotating the crank shaft is capable of holding the slide's oscillation frequency virtually constant during the oscillation process, and thereby of holding the pressing load virtually constant even during the oscillation process, thus improving the precision with which the workpiece is molded.

Furthermore, as any one of the third, fourth, sixth and seventh aspects of the present invention, even the crank press machine which raises and lowers the slide by rotating the crank shaft is capable of holding the slide's oscillation frequency virtually constant during the oscillation process, and thereby of holding the pressing load virtually constant during the oscillation process, as well as thus of improving the precision with which the workpiece is molded, in the case where the motion pattern is generated on the basis of the first motion datum, and the electric motor is controlled on the basis of the motion pattern.

Moreover, the fourth aspect of the present invention enables the operator to easily carry out the operation for inputting the first motion datum or the second motion datum, because any one of the first motion datum receiving screen or the second motion datum receiving screen is displayed in accordance with the operator's selection.

In addition, the fifth or eighth aspect of the present invention is capable of reducing time needed for the oscillation process, and accordingly of enhancing the productivity. This is because the fifth or eighth aspect of the present invention is capable of applying the oscillation process to the workpiece using the cooperation between the punching mold and the die mold while oscillating the slide without carrying out any return operation by raising the slide. Furthermore, for the same reason, the fifth or eighth aspect of the present invention is capable of eliminating the abrasion between the punch mold and the workpiece, of checking the wear of the mold, and thereby of extending the life of the punching mold, as well as of making it less likely that the workpiece may be damaged, thereby improving the processing quality.

Moreover, the sixth or seventh aspect of the present invention is capable of reducing time needed for the oscillation process, and accordingly of enhancing the productivity. This is because the sixth or seventh aspect of the present invention is capable of applying the oscillation process to the workpiece using the cooperation between the punching mold and the die mold while oscillating the slide without carrying out any return operation by raising the slide, in the case where the motion pattern is generated on the basis of the third motion datum, and where the electric motor is controlled on the basis of the motion pattern. Furthermore, for the same reason, the sixth or seventh aspect of the present invention is capable of eliminating the abrasion between the punch mold and the workpiece, of checking the wear of the mold, and thereby of extending the life of the punching mold, as well as of making it less likely that the workpiece may be damaged, thereby improving the processing quality.

The seventh aspect of the present invention enables the operator to easily carry out the operation for inputting the first motion datum, the second motion datum or the third motion datum, because any one of the first motion datum receiving screen, the second motion datum receiving screen and the third motion datum receiving screen is displayed in accordance with the operator's selection.

BEST MODE FOR CARRYING OUT THE INVENTION

Descriptions will be provided hereinbelow for the embodiment of the present invention with reference to FIGS. 1 to 6.

Figure 1:
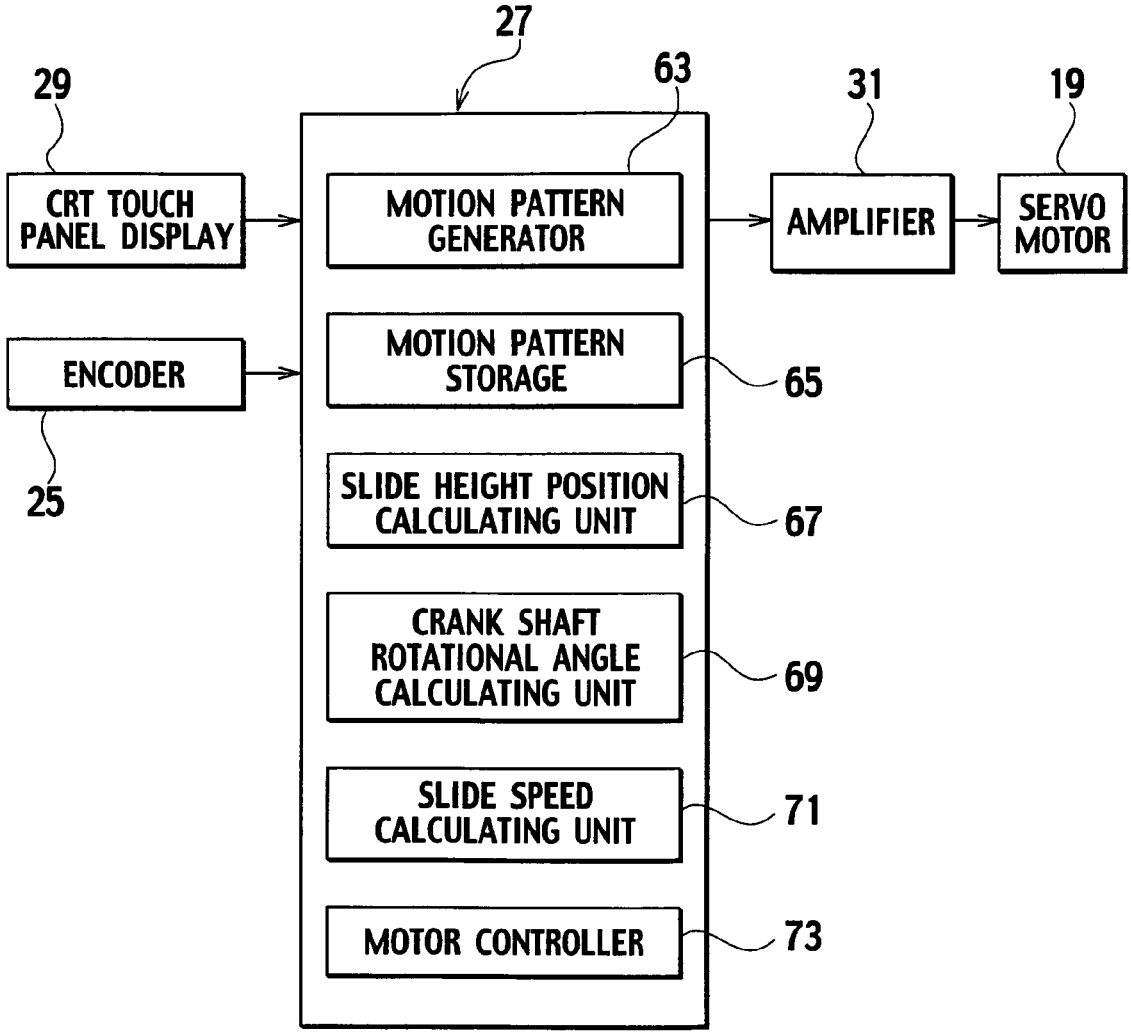
FIG. 1 is a control block diagram according to an embodiment of the present invention.
Figure 2:
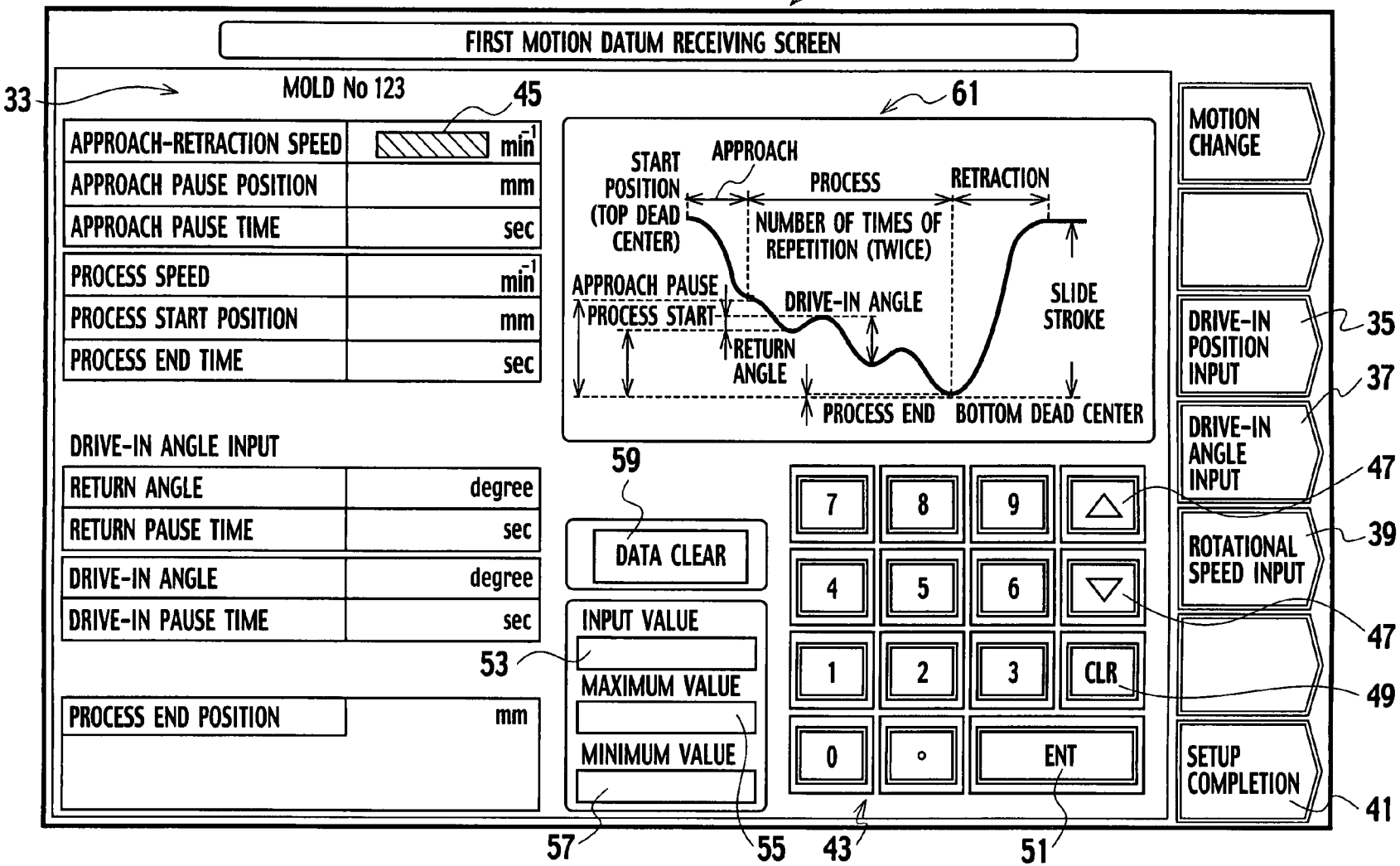
FIG. 2 is a diagram showing a first motion datum receiving screen displayed on a CRT touch panel display.
Figure 3:
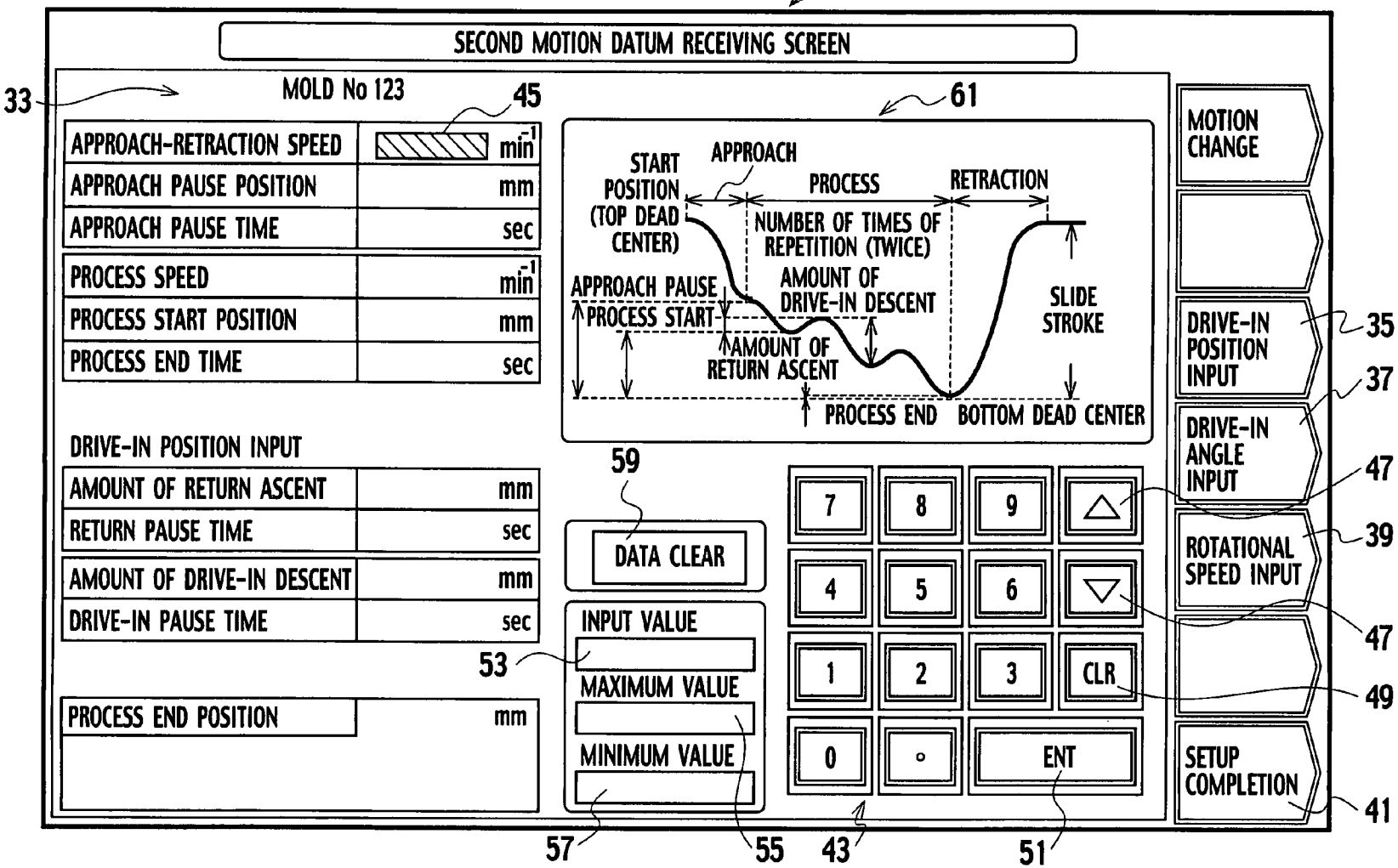
FIG. 3 is a diagram showing a second motion datum receiving screen displayed on the CRT touch panel display.
Figure 4:
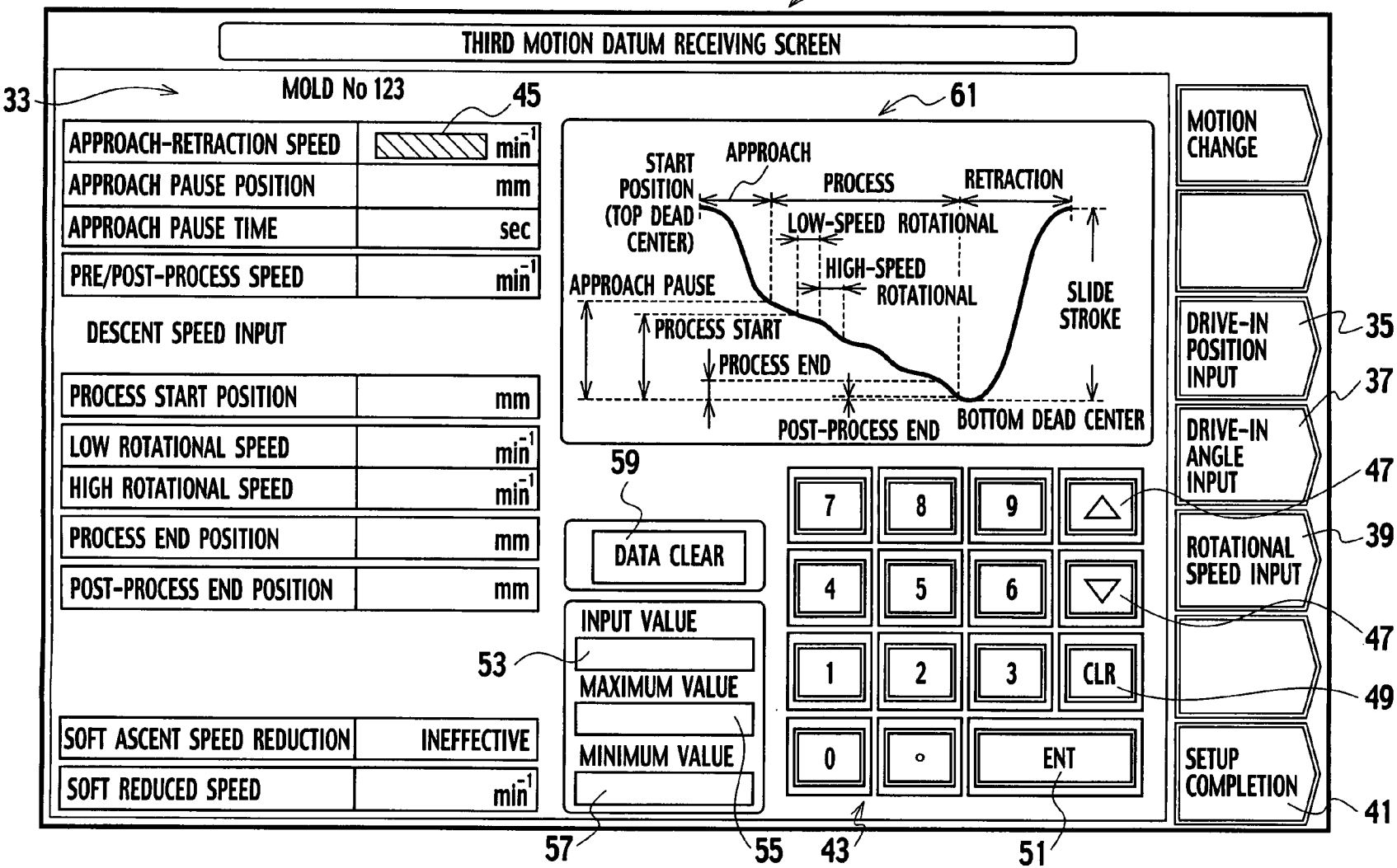
FIG. 4 is a diagram showing a third motion datum receiving screen displayed on the CRT touch panel display.
Figure 5:
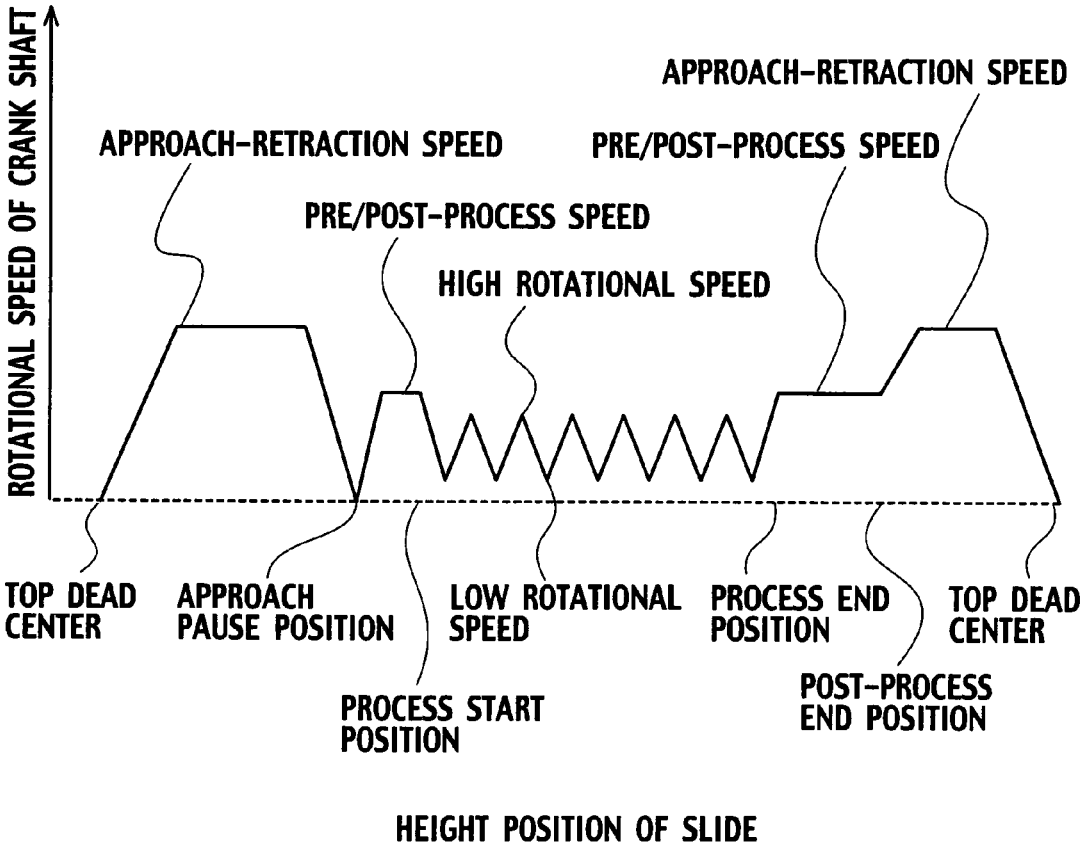
FIG. 5 is a diagram showing a relationship between a rotational speed of a crank shaft and a height position of a slide for another mode of the oscillation process.
Figure 6:
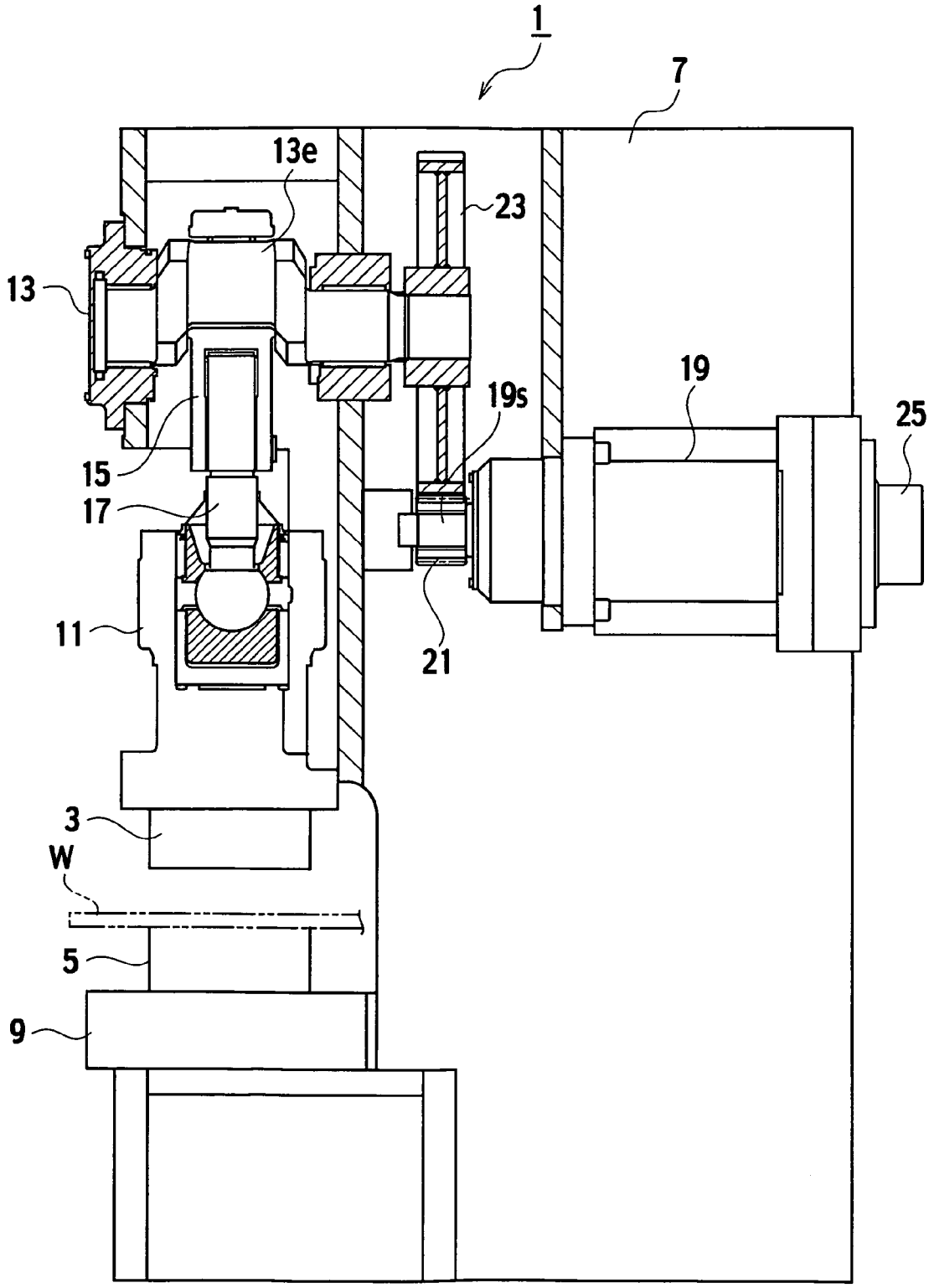
FIG. 6 is a side cross-sectional view of a crank press machine according to the embodiment of the present invention.

FIG. 1 is a control block diagram according to an embodiment of the present invention. FIG. 2 is a diagram showing a first motion datum receiving screen displayed on a CRT touch panel display. FIG. 3 is a diagram showing a second motion datum receiving screen displayed on the CRT touch panel display. FIG. 4 is a diagram showing a second motion datum receiving screen displayed on the CRT touch panel display. FIG. 5 is a diagram showing a relationship between a rotational speed of a crank shaft and a height position of a slide for another mode of the oscillation process. FIG. 6 is a side cross-sectional view of a crank press machine according to the embodiment of the present invention.

As shown in FIG. 6, the crank press machine 1 according to the embodiment of the present invention is that for pressing a workpiece W (including application of an oscillation process) using cooperation between a punching mold 3 and a die mold 5, and uses a main body frame 7 as a base.

A bolster 9 is provided to the lower portion of the main body frame 7. The die mold 5 is detachably provided to the top of this bolster 9. In addition, a slide 11 is provided above the bolster 9 in the main body frame 7 in a way that the slide 11 is capable of being raised and lowered (or is movable upward and downward). The punching mold 3 is detachably provided to the bottom of this slide 11.

A crank shaft 13 extending in the front-rear direction is rotatably provided to an upper portion of the main body frame 7. This crank shaft 13 includes an eccentric part 13*e* which is vertically eccentric. The upper end portion of an upper connecting rod 15 is rotatably connected to the eccentric part 13*e* of the crank shaft 13. The upper end portion of a lower connecting rod 17 is integrally connected to the lower end portion of the upper connecting rod 15 by screwing. The lower end portion of this lower connecting rod 17 is swingably connected to a part of the slide 11.

A servo motor 19 for raising and lowering the slide 11 by rotating the crank shaft 13 is provided at the rear of the slide 11 in the main body frame 7. A driving gear 21 is integrally provided to an output shaft 19 of this servo motor 19. A driven gear 23 meshing with this driving gear 21 is integrally provided to the rear end portion of the crank shaft 13. Furthermore, an encoder 25 for detecting the number of revolution of the output shaft 19*s* of the servo motor 19 is provided to the servo motor 19.

As a result, the crank press machine 1 is capable of processing the work W using cooperation between the punching mold and the die mold by raising and lowering the slide 11 (or moving the slide 11 upward and downward) through rotating the crank shaft 13 with the drive of the servo motor 19 by use of the driving gear 21 and the driven gear 23.

The crank press machine 1 is capable of carrying out an oscillation process using the cooperation between the punching mold 3 and the die mold 5 while oscillating the slide 11 by alternately repeating what is termed as a drive-in operation and what is termed as a return operation, in addition to carrying out a regular pressing work. The drive-in operation is that for causing the punching mold 3 to drive the workpiece W into the die mold 5 by lowering the slide 11. The return operation is that for causing the punching mold 3 to return upward by raising the slide 11.

The crank press machine 1 is capable of carrying out a second mode of oscillation process using the cooperation between the punching mold 3 the die mold 5 while oscillating the slide 11 by alternately repeating what is termed as a low-speed rotational operation and what is termed as a high-speed rotational operation, in addition to carrying out the foregoing oscillation process. The low-speed rotational operation is that for lowering the slide 11 at a low speed. The high-speed rotational operation is that for lowering the slide 11 at a high speed. It should be noted that the oscillation during the oscillation process does not necessarily involve upward and downward displacements.

The crank press 1 includes a controller 27 for doing things such as controlling the servo motor 19, in addition to the servo motor for raising and lowering the slide 11. The encoder 25, a CRT touch panel display 29 and an amplifier 31 for controlling the electric current flowing through the servo motor 19 are electrically connected to the controller 27. The CRT touch panel display 29 is that through which, by an input operation, an operator selects and inputs any one of a first motion datum, a second motion datum and a third motion datum.

The first motion datum includes, as input items, a height position at which the slide 11 starts the oscillation process (a process start position) and a time for which the slide 11 is paused (a process pause time), a height position at which the slide 11 ends the oscillation process (a process end position), a speed at which the slide 11 carries out the oscillation process, that is, a speed at which the crank shaft 13 is rotated (a process speed), an angle at which the crank shaft 13 is rotated in a first direction during the drive-in operation in the course of the oscillation process (a drive-in angle), a time for which the side 11 is paused during the drive-in operation in the course of the oscillation process (a drive-in pause time), an angle at which the crank shaft 13 is rotated in a second direction during the return operation in the course of the oscillation process (a return angle), a time for which the slide 11 is paused during the return operation in the course of the oscillation process (a return pause time), a height position at which the slide 11 is positioned when the punching mold 3 approaches the workpiece W (an approach pause position) and a time for which the slide 11 is paused at this time (an approach pause time), as well as a speed at which the slide 11 is lowered from the top dead center to the approach pause position and at which the slide 11 is raised from the process end position to the top dead center for the return, that is, an angle at which the crank shaft 13 is rotated (an approach-retraction speed).

The second motion datum includes, as input items, a process start position, a process pause time, a process end time, a process speed, how much the slide 11 is lowered during the drive-in operation (an amount of drive-in descent), a drive-in pause time, how much the slide 11 is raised during the return operation (an amount of return ascent), a return pause time, an approach pause position, an approach pause time, and an approach-retraction speed.

The third motion datum includes, as input items, a process start position, a process end position, a speed at which the crank shaft 13 is rotated during the low-speed rotational operation in the course of the oscillation process (a low-speed rotational speed), an angle at which the crank shaft 13 is rotated during the high-speed rotational operation in the course of the oscillation process (a high-speed rotational speed), a height position at which the slide 11 ends a post-process after the oscillation process (a post-process end position), a speed at which the crank shaft 13 is rotated during a pre-process before the oscillation process and during the post-process (a pre/post-process speed), an approach pause position, an approach pause time, a speed at which the crank shaft 13 is rotated when the slide 11 is lowered from the top dead center to the approach pause position and when the slide 11 is raised from the post-process end position to the top dead center for the return (an approach-retraction speed), choice of whether or not to temporarily reduce the rotational speed of the crank shaft 13 at the approach pause position in the middle of raising the slide 11 from the post-process end position to the top dead center for the return (choice between effective and ineffective), and a speed to which the rotational speed of the crank shaft 13 is reduced when effective is chosen (a soft reduced speed). It should be noted that the process start position may be equal to the approach pause position, and that the process end position may be equal to the post-process end position as a result of omitting the post-process.

In addition to the function as the motion datum receiving unit (module) through which, by an input operation, the operator inputs any one of the first motion datum, the second motion datum and the third motion datum by selection, the CRT touch panel display 29 has the following function. Specifically, the CRT touch panel display 29 includes a function as a motion datum receiving screen display for selecting and displaying any one of a first motion datum receiving screen (see FIG. 2), a second motion datum receiving screen (see FIG. 3), and a third motion datum receiving screen (see FIG. 4). The first motion datum receiving screen is that with which the operator carries out an operation for inputting the first motion datum. The second motion datum receiving screen is that with which the operator carries out an operation for inputting the second motion datum. The third motion datum receiving screen is that with which the operator carries out an operation for inputting the third motion datum.

As shown in FIGS. 2 to 4, the left portion of each of the motion datum receiving screens (the first motion datum receiving screen, the second motion datum receiving screen, and the third motion datum receiving screen) is provided with an input value displaying part 33 for displaying input values concerning the input items including the process start position. The right portion of each of the motion datum receiving screens is provided with a drive-in position input selecting key 35, a drive-in angle input selecting key 37, a rotational speed input selecting key 39, a setup completion key 41 and the like. A ten-key pad 43, a cursor moving key 47 for moving a cursor 45 displayed in the input value displaying part 33, a clear key 49, and an enter key 51 between the input value displaying part 33 and the setup completion key 41. Between the input value displaying part 33 and the ten-key pad 43, provided are a pre-confirmed input displaying part 53 for displaying a pre-confirmed input value, a maximum value displaying part 55 for displaying a maximum value of an input item inputted by use of the ten-key pad 43, a minimum value displaying part 57 for displaying a minimum value of an input item inputted by use of the ten-key pad 43, and a data clear key 59 for clearing all the input values displayed on the input value displaying part 33. In addition, an operation displaying part 61 for schematically displaying an operation of the slide 11 is provided above the ten-key pad 43 in each of the motion datum receiving screens.

The first motion datum receiving screen or the third motion datum receiving screen is designed to be switched to the second motion datum receiving screen when the operator presses the drive-in position input selecting key 35 in a corresponding one of the first motion datum receiving screen and the third motion datum receiving screen. In addition, the second motion datum receiving screen or the third motion datum receiving screen is designed to be switched to the first motion datum receiving screen when the operator presses the drive-in angle input selecting key 37 in a corresponding one of the second motion datum receiving screen and the third motion datum receiving screen. Furthermore, the first motion datum receiving screen or the second motion datum receiving screen is designed to be switched to the third motion datum receiving screen when the operator presses the rotational speed input selecting key 39 in a corresponding one of the first motion datum receiving screen and the second motion datum receiving screen.

The controller 27 includes a CPU, a ROM, a RAM and the like. The CPU in the controller 27 has a function as a motion pattern generator 63 for generating a motion pattern of the slide 11 on the basis of a motion datum inputted through the CRT touch panel display 29. The ROM in the controller 27 has a function as a motion pattern storage 65 in which the motion pattern generated by the motion pattern generator 63 is stored in association with mold numbers (numbers respectively assigned to the punching mold 3 and the die mold 5).

The CPU in the controller 27 has a function as a slide height position calculating unit 67 for calculating a height position of the slide 11 on the basis of a detection signal from the encoder 25, a function as a crank shaft rotational angle calculating unit 69 for calculating a rotational angle of the crank shaft 13 on the basis of a detection signal from the encoder 25, and a function as a slide speed calculating unit 71 for calculating a speed of the slide 11 on the basis of a detection signal from the encoder 25. In addition, on the basis of the motion pattern stored in the motion pattern storage 65, the CPU in the controller 27 has a function as a motor controller 73 for controlling the servo motor 19 via the amplifier 31 in order that: the height position of the slide 11, calculated by the slide height position calculating unit 67, coincides with a target height position; the rotational angle of the crank shaft 13, calculated by the crank shaft rotational angle calculating unit 69, coincides with a target rotational angle; and the speed of the slide 11, calculated by the slide speed calculating unit 71, coincides with a target speed.

Next, descriptions will be provided for specific details of the aforementioned second mode of oscillation process.

As shown in FIG. 5, the slide 11 is moved from the top dead center to the approach pause position by rotating the crank shaft 13 in the first direction at the approach-retraction speed. Subsequently, the slide 11 is further moved from the approach pause position to the process start position by rotating the crank shaft 13 in the first direction at the pre/post-process speed. Thereafter, the slide 11 is moved from the process start position to the process end position by alternately repeating the low-speed rotational operation for lowering the slide 11 through rotating the crank shaft in the first direction at low speed, and the high-speed rotational operation for lowering the slide through rotating the crank shaft 13 in the first direction at high speed. This allows the crank press machine to apply the oscillation process to the workpiece W using the cooperation between the punching mold 3 and the die mold 5 while oscillating the slide 11 without carrying out any return operation by raising the slide 11.

After the oscillation process is applied to the workpiece W, the slide 11 is moved from the process end position to the final process end position by rotating the crank shaft 13 in the first direction at the pre/post-process speed. Thereby, the post-process is applied to the workpiece W. Subsequently, the slide 11 is moved from the post-process end position to the top dead center by rotating the crank shaft 13 in the first direction at the approach-retraction speed. Thereby, the slide 11 is returned to the original condition. It should be noted that the post-process may be omitted from the second mode of oscillation process.

Descriptions will be provided hereinafter for operations of the embodiment of the present invention.

When inputting the first motion datum to the CRT touch panel display 29, the first motion datum receiving screen is displayed by the CRT touch panel display 29 in accordance with the operator's selection. When inputting the second motion datum to the CRT touch panel display 29, the second motion datum receiving screen is displayed by the CRT touch panel display 29 in accordance with the operator's selection. When inputting the third motion datum to the CRT touch panel display 29, the third motion datum receiving screen is displayed by the CRT touch panel display 29 in accordance with the operator's selection. Once any one of the first motion datum, the second motion datum and the third motion datum is inputted through the CRT touch panel display 29, the motion pattern generator 63 generates a motion pattern of the slide 11 on the basis of the motion datum inputted through the CRT touch panel display 29. In addition, the motion pattern generated by the motion pattern generator 63 is stored in the motion pattern storage 65. With this, the preparation for applying the oscillation process to the work W (the preparation for the oscillation process) ends.

After the preparation for the oscillation process is completed, the workpiece W is positioned at a predetermined position between the punching mold 3 and the die mold 5. Subsequently, on the basis of the motion pattern which is associated with the molds (the punching mold 3 and the die mold 5), and which is stored in the motion pattern storage 65, the motor controller 73 controls the servo motor 19 via the amplifier 31 in order that: the height position of the slide 11, calculated by the slide height position calculating unit 67, coincides with a target height position; a rotational angle of the crank shaft 13, calculated by the crank shaft rotational angle calculating unit 69, coincides with a target rotational angle; and the speed of the slide 11, calculated by the slide speed calculating unit 71, coincides with a target speed. This allows the crank press machine to apply the oscillation process to the workpiece W using the cooperation between the punching mold 3 and the die mold 5 while oscillating the slide 11 by alternately repeating the drive-in operation and the return operation. In this respect, in the case where the motion pattern is generated on the basis of the third motion datum and the servo motor 19 is controlled on the basis of this motion pattern, the crank press machine is allowed to apply the oscillation process to the workpiece W using the cooperation between the punching mold 3 and the die mold 5 while oscillating the slide 11 by alternately repeating the low-speed rotational operation and the high-speed rotational operation without carrying out any return operation raising the slide 11. Incidentally, a specific frequency of the oscillation process according to the embodiment of the present invention is 5 Hz to 10 Hz, for example.

Even when the drive-in operation and the return operation (or the low-speed rotational operation and the high-speed rotational operation) are increased in number, that is to say, even when the number of times the slide 11 is oscillated is increased, the crank press machine is capable of checking the increase in the number of input items included in any one of the motion data. This is because the motion pattern is generated on the basis of the first motion datum, the second motion datum or the third motion datum. The first motion datum includes, as the input items, the process start position, the process pause time, the process end position, the process speed, the drive-in angle, the drive-in pause time, the return angle, the return pause time, the approach pause position, the approach pause time, and the approach-retraction speed. The second motion datum includes, as the input items, the process start position, the process pause position, the process end position, the process speed, the amount of drive-in descent, the drive-in pause time, the amount of return ascent, the return pause time, the approach pause position, the approach pause time and the approach-retraction speed. The third motion datum includes, as the input items, the process start position, the process end position, the low descent speed, the high descent speed, the post-process end position, the pre/post-process speed, the approach pause position, the approach pause time, the approach-retraction speed, the choice between the effective and ineffective, and the soft reduced speed. For the same reason, a slight modification in the motion datum is sufficient for the press machine to cope particularly with a case where, as one of the input items included in the motion datum, the height position at which the slide starts the oscillation process needs to be changed.

Even the crank press machine 1 which raises and lowers the slide 11 by rotating the crank shaft 13 is capable of holding the oscillations frequency of the slide 11 virtually constant during the oscillation process, in the case where the servo motor 19 is controlled on the basis of the motion pattern generated on the basis of the first motion datum, the first motion datum including the drive-in angle and the return angle as input items.

As described above, even when the number of times the slide 11 is oscillated is increased, the embodiment of the present invention makes it possible to check the increase in the number of input items included in any one of the motion data, and thus to check the increase in time needed for the operator to input the datum, as well as to accordingly enhance the operator's work efficiency. A slight modification in the motion datum is sufficient for the press machine to cope particularly with a case where, as one of the input items included in the motion datum, the height position at which the slide starts the oscillation process needs to be changed. This makes it possible to enhance the operator's work efficiency.

Furthermore, even the crank press machine which raises and lowers the slide by rotating the crank shaft is capable of holding the slide's oscillation frequency virtually constant during the oscillation process, in the case where the motion pattern is generated on the basis of the first motion datum, and the servo motor 19 is controlled on the basis of the motion pattern. Thus the crank press machine is capable of holding the pressing load virtually constant during the oscillation process, as well as of improving the precision with which the workpiece is molded.

Moreover, the oscillation process is capable of being applied to the workpiece W using the cooperation between the punching mold 3 and the die mold 5 while oscillating the slide 11 without carrying out any return operation by raising the slide 11, in the case where the motion pattern is generated on the basis of the third motion datum, and the servo motor 19 is controlled on the basis of the motion pattern. For this reason, time needed for the oscillation process can be reduced, and the productivity can accordingly be enhanced. Furthermore, for the same reason, the abrasion between the punch mold 3 and the workpiece W can be eliminated, and the wear of the punching mold 3 is checked, thereby extending the life of the punching mold 3. Concurrently, the workpiece W becomes less likely to be damaged, thereby enhancing the processing quality.

Because the CRT touch panel display 29 display any one of the first motion datum receiving screen, the second motion datum receiving screen and the third motion datum receiving screen in accordance with the operator's selection, the operator can easily carry out the operation for inputting the first motion datum, the second motion datum or the third motion datum.

All the contents of Japanese Patent Application No. 2005-188825 (filed on Jun. 28, 2005) and Japanese Patent Application No. 2006-171463 (filed on Jun. 21, 2006) are incorporated in the description of the present invention by reference.

The present invention is not limited to the description of the embodiment of the invention. The present invention can be carried out as other various modes by modifying the present invention depending on the necessity.

The invention claimed is:

1. A press machine that performs an oscillation process which includes alternately repeating a drive-in operation which causes a punching mold to drive a workpiece into a die mold by lowering a slide, and a return operation which returns the punching mold upward by raising the slide, the press machine comprising:

an actuator which raises and lowers the slide;

a motion datum receiving module through which, by an input operation, an operator inputs a motion datum including, as input items, a height position at which the slide starts the oscillation process, a height position at which the slide ends the oscillation process, a speed at which the slide carries out the oscillation process, a lowered amount of the slide during the drive-in operation, and a raised amount of the slide during the return operation;

a motion pattern generator which generates a motion pattern of the slide on the basis of the motion datum inputted through the motion datum receiving module; and an actuator controlling module which controls the actuator on the basis of the motion pattern generated by the motion pattern generator.

2. A crank press machine that performs an oscillation process which includes alternately repeating a drive-in operation which causes a punching mold to drive a workpiece into a die mold by lowering the slide by rotating a crank shaft in a first direction, and a return operation which returns the punching mold upward by raising the slide by rotating the crank shaft in a second direction, the crank press machine comprising:

an electric motor which raises and lowers the slide by rotating the crank shaft;

a motion datum receiving module through which, by an input operation, an operator inputs a motion datum including, as input items, a height position at which the slide starts the oscillation process, a height position at which the slide ends the oscillation process, a speed at which the slide carries out the oscillation process, an angle at which the crank shaft is rotated in the first direction during the drive-in operation, and an angle at which the crank shaft is rotated in the second direction during the return operation;

a motion pattern generator which generates a motion pattern of the slide on the basis of the motion datum inputted through the motion datum receiving module; and a motor controller which controls the electric motor on the basis of the motion pattern generated by the motion pattern generator.

3. A crank press machine that performs an oscillation process which includes alternately repeating a drive-in operation which causes a punching mold to drive a workpiece into a die mold by lowering a slide by rotating a crank shaft in a first direction, and a return operation which returns the punching mold upward by raising the slide by rotating the crank shaft in a second direction, the crank press machine comprising:

an electric motor which raises and lowers the slide by rotating the crank shaft;

a motion datum receiving module through which, by an input operation, an operator inputs any one of a first motion datum and a second motion datum by selection, the first motion datum including, as input items, a height position at which the slide starts the oscillation process, a height position at which the slide ends the oscillation process, a speed at which the slide carries out the oscillation process, an angle at which the crank shaft is rotated in the first direction during the drive-in operation, and an angle at which the crank shaft is rotated in the second direction during the return operation, the second motion datum including, as input items, a height position at which the slide starts the oscillation process, a height position at which the slide ends the oscillation process, a speed at which the slide carries out the oscillation process, a lowered amount of the slide during the drive-in operation, and a raised amount of the slide during the return operation;

a motion pattern generator which generates a motion pattern of the slide on the basis of the motion datum inputted through the motion datum receiving module; and a motor controller which controls the electric motor on the basis of the motion pattern generated by the motion pattern generator.

4. The crank press machine according to claim 3, further comprising a motion-datum-receiving-screen display which displays any one of a first motion datum receiving screen and a second motion datum receiving screen in accordance with the operator's selection, the first motion datum receiving screen corresponding to an operation for inputting the first motion datum, and the second motion datum receiving screen corresponding to an operation for inputting the second motion datum.

5. A press machine that performs an oscillation process which includes alternately repeating a low-speed rotational operation for lowering a slide by rotating a crank shaft in a direction at a low speed, and a high-speed rotational operation for lowering the slide by rotating the crank shaft in the first direction at a high speed, the press machine comprising:

an electric motor which raises and lowers the slide by rotating the crank shaft;

a motion datum receiving module through which, by an input operation, an operator inputs a motion datum including, as input items, a height position at which the slide starts the oscillation process, a height position at which the slide ends the oscillation process, a speed at which the crank shaft is rotated during the low-speed rotational operation, and a speed at which the crank shaft is rotated during the high-speed rotational operation;

a motion pattern generator which generates a motion pattern of the slide on the basis of the motion datum inputted through the motion datum receiving module; and an actuator controlling module which controls the actuator on the basis of the motion pattern generated by the motion pattern generator.

6. A crank press machine that performs an oscillation process which includes alternately repeating a drive-in operation which causes a punching mold to drive a workpiece into a die mold by lowering the slide by rotating a crank shaft in a first direction, and a return operation which returns the punching mold upward by raising the slide by rotating the crank shaft in a second direction, or which includes alternately repeating a low-speed rotational operation for lowering the slide by rotating a crank shaft in the first direction at a low speed and a high-speed rotational operation for lowering the slide by rotating the crank shaft in the first direction at a high speed, comprising:

an electric motor which raises and lowers the slide by rotating the crank shaft;

a motion datum receiving module through which, by an input operation, an operator inputs any one of a first motion datum, a second motion datum and a third motion datum by selection, the first motion datum including, as input items, a height position at which the slide starts the oscillation process, a height position at which the slide ends the oscillation process, a speed at which the slide carries out the oscillation process, an angle at which the crank shaft is rotated in the first direction during the drive-in operation, and an angle at which the crank shaft is rotated in the second direction during the return operation, the second motion datum including, as input items, a height position at which the slide starts the oscillation process, a height position at which the slide ends the oscillation process, a speed at which the slide carries out the oscillation process, a lowered amount of the slide during the drive-in operation, and a raised amount of the slide during the return operation, the third motion datum including, as input items, a height position at which the slide starts the oscillation process, a height position at which the slide ends the oscillation process, a speed at which the crank shaft is rotated during the low-speed rotational operation, and a speed at which the crank shaft is rotated during the high-speed rotational operation;

a motion pattern generator which generates a motion pattern of the slide on the basis of the motion datum inputted through the motion datum receiving module; and a motor controller which controls the electric motor on the basis of the motion pattern generated by the motion pattern generator.

7. The crank press machine according to claim 6, further comprising a motion-datum-receiving-screen display which displays any one of a first motion datum receiving screen, a second motion datum receiving screen and a third motion datum receiving screen in accordance with the operator's selection, the first motion datum receiving screen corresponding to an operation for inputting the first motion datum, the second motion datum receiving screen corresponding to an operation for inputting the second motion datum, and the third motion datum receiving screen corresponding to an operation for inputting the third motion datum.

8. An oscillation processing method for a press machine, comprising:

alternately repeating a low-speed rotational operation the which lowers a slide by rotating a crank shaft in a direction at a low speed, and a high-speed rotational operation which lowers the slide by rotating the crank shaft in the direction at a high speed.

* * * * *

UNITED STATES PATENT AND TRADEMARK OFFICE

CERTIFICATE OF CORRECTION

PATENT NO. : 7,926,317 B2
APPLICATION NO. : 11/994009
DATED : April 19, 2011
INVENTOR(S) : M. Soga et al.

It is certified that error appears in the above-identified patent and that said Letters Patent is hereby corrected as shown below:

On the Title page, (75) Inventors, of the printed patent, please change the city of M. Soga and H. Itakura from "Isehara" to -- Kanagawa --.

At column 20, line 3 (claim 8, line 3) of the printed patent, please remove the word "the" after "operation".

Signed and Sealed this
Twenty-second Day of November, 2011

David J. Kappos

David J. Kappos
*Director of the United States Patent and Trademark Office*